United States Patent [19]

Eagle

[11] Patent Number: 4,550,648

[45] Date of Patent: Nov. 5, 1985

[54] ATTIC VENTILATION SYSTEM

[76] Inventor: Jon R. Eagle, 10625 Vessey Rd., Bloomington, Minn. 55437

[21] Appl. No.: 512,780

[22] Filed: Jul. 11, 1983

[51] Int. Cl.[4] ..... F24F 13/18

[52] U.S. Cl. ..... 98/37; 98/121.1; 98/DIG. 6

[58] Field of Search ..... 55/506; 98/29, 32, 37, 98/42 R, 88 S, 99.8, 114, 121 R, DIG. 6; 160/105, 368 R, 369

[56] References Cited

U.S. PATENT DOCUMENTS

| | | | |
|---|---|---|---|
| 964,146 | 7/1910 | Clark | 98/37 |
| 1,640,588 | 8/1927 | Yager et al. | 98/121 R |
| 2,342,965 | 2/1944 | Palmer | 98/114 |
| 2,513,056 | 6/1950 | Scallon | 98/29 |
| 2,792,881 | 5/1957 | Hawley | 160/369 X |
| 3,115,082 | 12/1963 | Sanoff | 98/37 |
| 3,192,849 | 7/1965 | Massengale | 98/37 |
| 3,232,205 | 2/1966 | Bumstead | 98/37 |
| 3,256,654 | 6/1966 | Pinckney, Jr. | 52/95 |
| 3,386,434 | 6/1968 | Castello et al. | 126/114 |
| 3,815,638 | 6/1974 | Martin | 98/114 X |
| 3,892,169 | 7/1975 | Jarnot | 98/37 |
| 3,938,429 | 2/1976 | Perry | 98/37 |
| 3,955,483 | 5/1976 | Sunter | 98/114 |
| 4,274,330 | 6/1981 | Witten et al. | 98/37 |
| 4,407,187 | 10/1983 | Horney | 98/114 |

*Primary Examiner*—Harold Joyce

*Attorney, Agent, or Firm*—Merchant, Gould, Smith, Edell, Welter & Schmidt

[57] ABSTRACT

A screen supporting frame for a ventilation opening in a building is disclosed. The frame is formed of a sheet metal strip cut and bent along its longitudinal access to provide a first generally flat portion for assuming a substantially flush position against the outside surface of the building when mounted, a second portion angularly extending from said first portion to form one or more longitudinally extending slots in which the screen or grate may slide permitting the installation removal thereof without tools. A sheet metal strip is further cut and bent transversely to its axis to provide one or more flexible third portions extending substantially orthogonal to the first portion in the direction opposite the second portions for extending inside the soffit opening and engaging in inside surface thereof to mount the first portion in the flush position without the aid of tools and connected at opposite ends thereof to form a rectangular frame sized to fit the opening.

4 Claims, 8 Drawing Figures

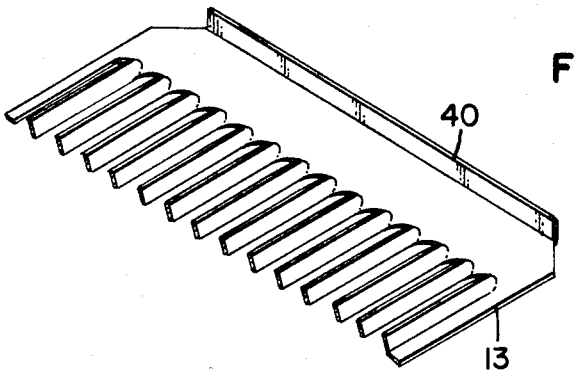
FIG. 4
FIG. 5
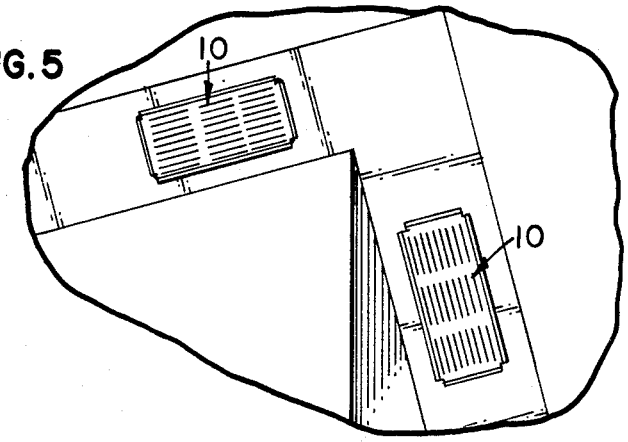
FIG. 6
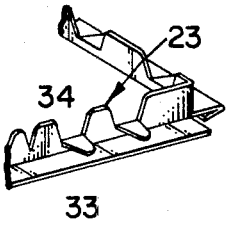
FIG. 7
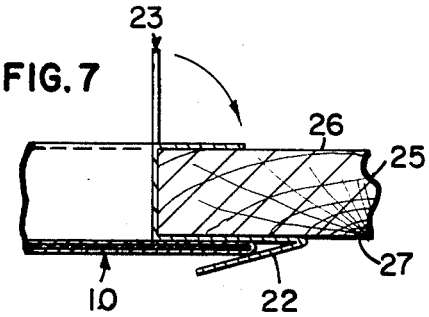
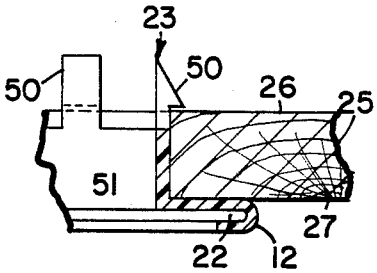
FIG. 8

ATTIC VENTILATION SYSTEM

TECHNICAL FIELD OF THE INVENTION

The present invention pertains to the field of building ventilation, and more particularly to a ventilation system for use in the attic space of a building.

BACKGROUND OF THE INVENTION

Most modern homes include openings between the attic space and the outside to provide ventilation. In the summer, ventilation may remove hot air from the attic space and thereby maintain cooler temperatures in the living quarters, while in the winter ventilation may serve to reduce potentially destructive condensation in the attic space, which is particularly problematic for the super insulated building.

Attic ventilation systems usually consist of two or more openings between the attic air space and the outside whereby air may flow between the openings by natural air currents or may be forced through the attic air space with a fan. The openings provided are most usually covered with a screen or grate to allow the passage of air therethrough while preventing encroachment of various pests such as bats, birds or insects. Naturally, it is not uncommon for the screens or grates to become clogged with seeds, dust, dirt or the like and thus must be cleaned at regular intervals to maintain the desired ventilation.

Generally, cleaning requires the removal of the screen or grate, and the reinstallation of the same. Because most attic ventilation openings are situated in the upper reaches of the building it is most often necessary to reach the same with a ladder. Thus, it is highly advantageous if the screen or grate may be installed or removed with a minimum of effort. Unfortunately, they are often secured in place with screws which in order to extract require the use of a screwdriver and not uncommonly a rather powerful forearm, especially where the screws have been painted over, as is all too often the case. Another common method of attachment involves use of nails. Again, use of tools is required and the worker can not hold securely to the ladder while using one hand to hold a nail and the other to hold a hammer. Similiarly, the reinstallation of the screws, particularly when the vent is situated in the underside of an overhanging soffit, can be a most trying experience.

Various means for providing a ventilation opening cover are provided in the prior art. For example, U.S. Pat. No. 3,232,205 to Bumstead discloses an attic ventilating system employing a cover assembly which includes a cover for the vent openings which may be hingeably connected over the ventilation opening without the use of screws. However, in this system the screen or grate used to cover the opening is permanently mounted with nails or screws over the opening, which is an extremely undesirable feature for the reasons pointed out above. In U.S. Pat. No. 3,938,429 to Perry, another ventilation system is disclosed. This system employs a pair of rails mounted on either side of the opening in which the air ventilation screens or grates may be slideably installed. While this system does manage to avoid the above described difficulties in removing, cleaning and reinstalling screens or grates the installation of the rails presents yet another difficulty. More specifically, these rails must be fastened, using nails, staples or the like, to the outside of the opening. In the case of an overhanging soffit, this installation can be particularly difficult especially where access is accomplished by ladder and performed by a sole installer. Still another vent opening covering system is disclosed in U.S. Pat. No. 4,274,330 to Witton et al. In this system a mounting frame is provided to be installed in an opening in a wall so that the ventilator grate may be slidingly positioned in the opening formed by the frame and held in place with some form of detent. However, this system, if employed in a horizontal soffit location would also present significant installation difficulties. More particularly, the installation of this frame is accomplished using fasteners which include a threaded bolt and clamping member of a generally hook-like configuration which must be adjusted and screwed into place, often a difficult task under the eaves of a building while balancing on a ladder.

SUMMARY OF THE INVENTION

The present invention provides a screen supporting frame for a ventilation opening in a building. A mounting frame for slideably receiving the screen or grate is provided and includes at least one pair of screen mounting members rigidly supported in a substantially parallel relationship. The mounting members each include on one side a plurality of longitudinally distributed mounting tabs for extending into the opening and securing the mounting members on opposite sides thereof without the use of tools. Each of the mounting members further include on a side generally opposite the one side a longitudinal slot for slideably receiving and holding the screen or grate over the opening in a substantially flush relationship with the face of the building.

According to one embodiment the mounting members are formed of sheet metal with the mounting tabs fashioned therefrom to extend into the opening and be bent down by the fingers of the installer to secure the mounting members in the soffit opening. According to another embodiment of the invention the frame or mounting members may be formed of resilient metal or plastic material with the mounting tabs sized to snap into place on the inside edge of the ventilation opening.

BRIEF DESCRIPTION OF THE DRAWINGS

In the drawing:

FIG. 4 is partial perspective view of an alternative embodiment of the louvered cover plate according to the present invention;

FIG. 5 is a perspective view of the present invention as mounted in a soffit opening;

FIG. 6 is a partial perspective view of an alternative embodiment of the frame mounting tabs accordingly to the present invention;

FIG. 7 is an enlarged fragmentary cross-sectional view of the preferred embodiment of the present invention; and FIG. 8 is an enlarged fragmentary cross-sectional view of an alternative embodiment of the present invention.

DETAILED DESCRIPTION OF THE INVENTION

In FIGS. 1, 3, 5 and 7 the preferred embodiment of the present invention is illustrated in several views. A screen or grate member 10 is provided to cover a ventilation opening, for example in the attic of a building, and to allow the passage of air therethrough while preventing the encroachment of animal pests or debris into the inside space. In many modern homes these openings are typically provided in the soffit enclosing the eaves as illustrated in FIG. 5. Member 10 may be formed of a meshed screen 11 in which case it is preferrable to provide a generally flat frame 12 around its perimeter to maintain it in a substantially planar shape. Member 10 may also include a decorative louvered panel 13, as may be seen in FIGS. 2 and 3, either alone or in combination with screen 11. In the case where they are provided in combination louvered panel 13 may double as a frame for the screen 11.

Figure 1:
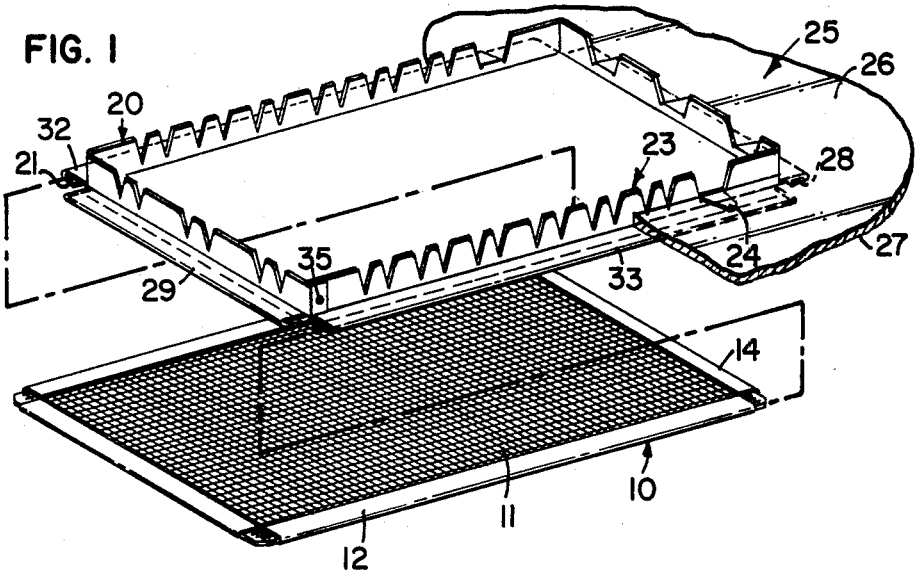
FIG. 1 is a perspective view of the preferred embodiment of the present invention.

A mounting frame 20 is provided to be mounted in the ventilation opening and to slideably receive screen member 10, for example by inserting the corner portions of end 14 into the respective slots 21 and 22 of flanges 32 and 33 of frame 20. A plurality of perpendicularly oriented hand bendable mounting tabs 23 are provided to extend into the ventilation opening and to be bent down away from the opening, as for example shown at 24, to secure frame 20 to the building structure 25, typically plywood or possibily aluminum, in which a first side 26 faces into the space to be ventilated and second side 27 faces outwardly of the building. These tabs may be provided on all four sides of frame 12, as shown in FIG. 1, or may be provided only on opposite sides of the frame.

In the preferred embodiment, frame 20 is constructed from a single piece of sheet metal of a gauge which provides sufficient structural rigidity to maintain its shape and sufficient flexibility to permit the mounting tabs 23 to be bent into their securing position with the fingers of the human hand. Thus, a properly sized frame 20 may be installed simply by inserting it into the ventilation opening and manually (without tools) bending as many of tabs 23 down as necessary to secure it to the building structure 25.

When frame 20 is constructed of a single strip of sheet metal, tabs 23 may be formed simply by cutting out selected portions of the sheet metal on one side of the strip. If desired, the sheet metal may be cut or trimmed to provide tabs with rounded edges or corners 34, as illustrated in FIG. 6. Similiarly, the sheet metal strip may be cut and bent along its longitudinal axis to provide the flange portions and slots, and then bent transversely to its axis to form a four sided frame, the ends thereof then connected as for example by a rivet 35. Thus, its construction is simple and inexpensive.

Frame 20 may also include a portion 28 on one end thereof for receiving and stopping end 14 of member 10, thus aiding the positioning of the screen or grate over the ventilation opening. On the other end of frame 20 another generally flat portion of flange 29 may be provided to abut or sit flush with side 27 of building structure 26. Ends 28 and 29 in addition act as rigid cross members holding the slotted flanges 31 and 32 of frame 20 in a parallel relationship.

Figure 2:
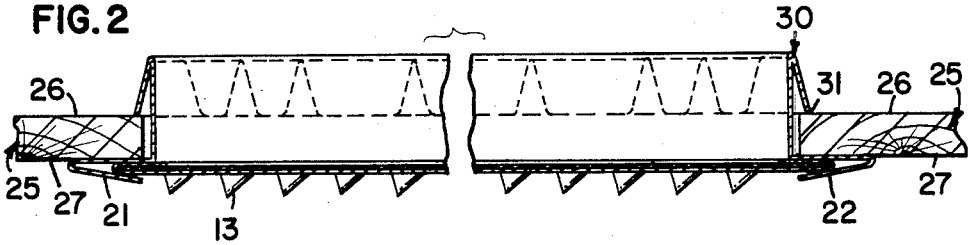
FIG. 2 is a cross sectional view of an alternative embodiment of the present invention.
Figure 3:
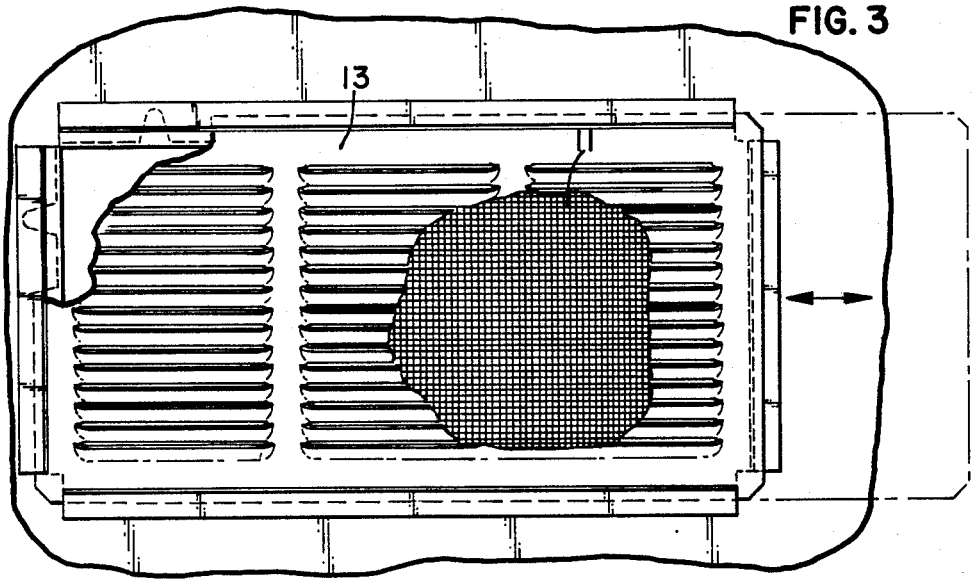
FIG. 3 is a plan view of the present invention mounted in a ventilation opening with portions thereof cut away.

An alternative embodiment of the frame 20 of the present invention is illustrated in FIG. 2. In this embodiment the mounting tabs 23 are configured to form a resilient snap with an acutely angled end 30 and sized so that ends 31 engage or snap into place against surface 26 when the frame 20 is mounted in the opening. Again, the mounting tabs may be constructed of sheet metal sufficiently resilient so that they may be slightly inwardly compressed or bent upon installation while passing through the opening, and then regain their shape, as for example shown in FIG. 2, when end 31 clears the opening and engages side 26 of structure 25. As in the case of the preferred embodiment of FIG. 1, these tabs may be provided on all four sides of the frame member or may be provided only on two opposite sides thereof so as to provide as a minimum the rigid parallel support of the slotted flanges 32 and 33 of frame 20.

In FIG. 4 there is illustrated an alternative embodiment of louvered plate 13 in which a perpendicularly extending lip or edge 40 is provided. Lip 40 may be utilized in order to grip the end of louvered panel 13 and to aid in sliding it in and out of the frame member 20. In the case where a screen 11 is provided without a louvered panel 13 it may be readily seen that this same type of lip portion 40 may be provided on the rigid frame 12 therefor.

In FIG. 8 another alternative embodiment of the frame 12 of the present invention is illustrated. In this embodiment frame 12 may be molded from a plastic material with the mounting tabs 23 configured as snaps having a head portion 50 and sized to snap inside the opening and engage surface 26 of structure 25 when the frame 12 is in its mounted position. A slot 22 for receiving the screen or grate member 10 is provided by molding the plastic into a hooked configuration, for example as illustrated with respect to slot 22 in the embodiment of FIG. 8. Naturally, the plastic must be of sufficient resilience to accommodate inward flexing thereof at or around end 51 as the frame passes through the ventilation opening.

Thus, it may be seen that the present invention provides a ventilation system which may be installed either in newly constructed buildings or easily retrofitted into existing structures. Tools are not required for installation of the frame nor for installation or removal of the screen or grate. Thus, the present invention provides for a significant reduction in both the time required to install the system and in the time required to install and remove the screen or grate for cleaning, while providing potentially substantially improvement in the safety of both of these operations.

It is to be understood, however, that even though numerous characteristics and advantages of the invention have been set forth in the foregoing description, together with details of the structure and function of the invention, the disclosure is illustrative only, and changes may be made in detail, especially in matters of shape, size and arrangement of parts within the principle of the invention, to the full extent indicated by the broad general meaning of the term in which the appended claims are expressed.

I claim:

1. A frame for securing a screen over a ventilation opening having a perimeter, said opening in a building, said frame comprising:

a pair of elongated screen mounting members and one or more rigid cross members holding said mounting members in a substantially parallel relationship, said mounting members and said cross members each including a plurality of longitudinally extended bendable mounting tab means for securing said mounting members substantially to said opening perimeter, and, said mounting members and said cross members are formed from sheet metal and wherein said mounting members and said cross members are secured to said opening perimeter by manually bending said tab means down on the inside of the opening to clamp said frame thereto, and each of said mounting members and one of said cross members further including on a side generally opposite said tab means, a longitudinal screen engaging slot and, at least one of said cross members connects corresponding ends of said parallel mounting members and includes a slot for slideably receiving the end of a screen.

2. A frame for use in a ventilation opening in a building comprising: an elongated sheet metal strip bent along its longitudinal axis to provide:

a first generally flat portion for assuming a substantially flush position against the opposite surface of the building when mounted;

a second portion angularly extended from said first portion to form a longitudinally extending slot in which the screen or grate may slide permitting the installation and removal thereof without tools;

a third portion extending substantially orthogonal to said first portion and cut transversely to said axis to provide one or more tabs for extending inside the opening and engaging an inside surface thereof; and said first and second portions being cut transversely to said axis in three places, intermediate the ends with said third portions being bent ninety degrees at each of said cuts to form said strip into a four legged rectangular shape the ends of said thusly bend strip being fastened together to form a rigid rectangular structure, with the said second portion on one of the sides of said rectangular shape being flattened against said first portion of said one side.

3. A frame for use in a ventilation opening in a building comprising: an elongated sheet metal strip bent along its longitudinal axis to provide:

a first generally flat portion for assuming a substantially flush portion against the opposite surface of the building when mounted;

a second portion angularly extended from said first portion to form a longitudinally extending slot in which a screen or grate may slide permitting the installation and removal thereof without tools;

a third portion extending substantially orthogonal to said first portion and cut transversely to said axis to provide one or more tabs for extending inside the opening and engaging an inside surface thereof; and said first and second portions being cut transversely to said axis in three places, intermediate the ends with said third portions being bent ninety degrees at each of said cuts to form said strip into a four-legged substantially rectangular shape the ends of said thusly bend strip being fastened together to form a rigid rectangular structure, with the said second portion on one of the sides of said rectangular shape being removed.

4. A building ventilation device comprising:

a rectangular ventilation screen;

an elongated sheet metal strip bent along its longitudinal axis to provide:

a first generally flat portion for assuming a substantially flush portion against the opposite surface of the building when mounted;

a second portion angularly extended from said first portion to form a longitudinally extending slot in which a screen or grate may slide permitting the installation and removal thereof without tools;

a third portion extending substantially orthogonal to said first portion and cut transversely to said axis to provide one or more hand bendable tabs for extending inside the opening and engaging an inside surface thereof when bent; and said first and second portions being cut transversely to said axis in three places, intermediate the ends with said three portions being bent ninety degrees at each of said cuts to form said strip into a four legged substantially rectangular shape sized to slideably and removably receive said screen within said longitudinally extending slot.

* * * * *